US010408586B1

(12) United States Patent
DeAngelis

(10) Patent No.: US 10,408,586 B1
(45) Date of Patent: Sep. 10, 2019

(54) VARIABLE RANGE TERMINAL KINETIC ENERGY LIMITING NON-LETHAL PROJECTILE

(71) Applicant: U.S. Government as Represented by the Secretary of the Army, Picatinny Arsenal, Dover, NJ (US)

(72) Inventor: Mario E. DeAngelis, Ringoes, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 13 days.

(21) Appl. No.: 15/718,262

(22) Filed: Sep. 28, 2017

(51) Int. Cl.
*F42B 10/50* (2006.01)
*F42C 13/00* (2006.01)
*F42B 10/56* (2006.01)

(52) U.S. Cl.
CPC ..... *F42B 10/50* (2013.01); *F42B 10/56* (2013.01); *F42C 13/006* (2013.01)

(58) Field of Classification Search
CPC .. F42B 10/50; F42B 10/56; F42B 4/12; F42B 4/28; F42B 12/62; F42B 12/625; F42B 8/00; F42B 8/02; F42B 8/10; F42B 8/12; F42C 13/006; F41H 13/0006
USPC ..... 102/502, 444, 446, 498, 529
See application file for complete search history.

(56) References Cited

U.S. PATENT DOCUMENTS 3,088,403 A * 5/1963 Bartling ..... F42B 15/22 102/390
3,636,877 A * 1/1972 Eaton, Jr. ..... F42B 10/14 102/378
3,780,657 A * 12/1973 Zaid ..... F42B 8/02 102/444
3,906,859 A * 9/1975 Smith ..... F42B 5/025 102/444
4,333,400 A * 6/1982 McNelia ..... F42C 21/00 102/348
4,753,171 A * 6/1988 Stessen ..... F42B 10/56 102/354
4,911,080 A * 3/1990 Leeker ..... F42B 10/50 102/489
5,221,809 A * 6/1993 Cuadros ..... F42B 12/34 102/439
5,239,927 A * 8/1993 Frye ..... F42B 10/56 102/340
5,343,795 A 9/1994 Ziemba
5,361,701 A * 11/1994 Stevens ..... C06B 33/00 102/450
5,370,057 A * 12/1994 Badura ..... F42B 10/56 102/354

(Continued)

*Primary Examiner* — Stephen Johnson
*Assistant Examiner* — Benjamin S Gomberg
(74) *Attorney, Agent, or Firm* — Michael C. Sachs

(57) ABSTRACT

A non-lethal projectile comprises a carrier with a deployable payload to allow for effective performance at both long and short ranges. The non-lethal projectile is fired from a launcher. At a predetermined range, the carrier opens thereby deploying the payload. The payload may further comprise a drogue chute to reduce the kinetic energy of the payload to a non-lethal level. Alternatively, the inherent drag coefficient of the payload may enable sufficient reduction of kinetic energy without the need for a drogue chute. The deployed petals of the carrier serve as drag surfaces for the carrier, thereby reducing the kinetic energy of the carrier to a non-lethal level.

9 Claims, 15 Drawing Sheets

(56) References Cited

U.S. PATENT DOCUMENTS

| | | | | |
|---|---|---|---|---|
| 5,497,704 | A * | 3/1996 | Kurschner | F42C 11/06 102/212 |
| 5,760,330 | A * | 6/1998 | Himmert | F42B 10/56 102/337 |
| 6,202,562 | B1 | 3/2001 | Brunn | |
| 6,755,133 | B1 * | 6/2004 | Brunn | F42B 12/34 102/444 |
| 6,782,829 | B1 | 8/2004 | Han | |
| 6,814,006 | B2 * | 11/2004 | Johansson | F42B 14/068 102/522 |
| 7,021,187 | B1 * | 4/2006 | Grassi | F42B 30/04 89/6.5 |
| 7,231,875 | B2 | 6/2007 | Rastegar | |
| 7,549,376 | B1 * | 6/2009 | Grossman | F42B 10/50 102/400 |
| 8,020,492 | B1 * | 9/2011 | Kapeles | F42B 10/02 102/502 |
| 8,256,351 | B1 | 9/2012 | Kramer | |
| 9,500,454 | B1 * | 11/2016 | Decker | F42B 10/56 |
| 2002/0178960 | A1 * | 12/2002 | Ramaswamy | F42B 12/36 102/439 |

* cited by examiner

VARIABLE RANGE TERMINAL KINETIC ENERGY LIMITING NON-LETHAL PROJECTILE

STATEMENT OF GOVERNMENT INTEREST

The inventions described herein may be manufactured, used and licensed by or for the United States Government.

BACKGROUND OF THE INVENTION

The invention relates in general to projectiles and in particular to non-lethal projectiles.

Non-lethal projectiles are valuable assets for law enforcement and military services. Typically used in crowd control, non-lethal projectiles may be deployed against unruly individuals to persuade them to desist with their activities and leave an area or to be temporarily disabled so that they can be taken into custody. The primary intent of these projectiles is to be non-lethal and not cause traumatic or long term injury yet still deliver sufficient blunt force to an individual to cause initial pain and discomfort.

Currently available non-lethal projectile designs, and their associated launching weapons, operate by limiting the projectile's kinetic energy that is delivered to a human target, below the level that would prove fatal or produce severe penetrating wounds. However, due to the wide range of non-lethal projectile designs currently available, no one particular value for the maximum kinetic energy is possible. The maximum non-lethal kinetic energy for a particular projectile design is dependent on several factors such as the projectile's velocity upon impact, its weight, and also the degree to which the projectile's material deforms upon impact to help distribute its energy and lessen the potential to penetrate the skin. These limitations therefore restrict the muzzle velocities that the non-lethal projectiles can be fired at which in turn limits their effective range. An example of a commercially available non-lethal projectile is a shot-filled bean bag fired from a 12-ga shotgun. The bean bag weighs 40 grams (1.4 oz.) and is fired at ~90 m/sec (300 ft/sec). The effective operating range is 5 meters to 20 meters to deliver less than 165 Joules of kinetic energy.

Commonly used non-lethal projectiles include rubber projectiles in the shape of bullets, or round balls, as well as shot-filled bean bags. These relatively soft or conforming materials usually means that the projectile's shape will not have sufficient aerodynamic qualities to travel long distances, without a large loss in velocity, and still have adequate accuracy. Accordingly, these limitations restrict their effective range from about 5 meters to 20 meters with accuracy of about 75 mm to 100 mm. Additionally, because of the limits on muzzle velocity most cartridges that fire non-lethal projectiles have reduced propelling charges. As a result, these cartridges are not sufficiently strong enough to cycle the launcher's bolt semi-automatically and therefore must be fired one at a time manually.

Other known non-lethal projectiles provide time delayed deployment of non-lethal components from a carrier to increase the effective distance of the munition. However, these projectiles are limited to chemical dispersants and may prove dangerous at close ranges as there is no mitigation of the carrier's velocity after deployment.

A need exists for an improved non-lethal projectile which is effective at both long and short ranges.

SUMMARY OF INVENTION

One aspect of the invention is a non-lethal projectile comprising a non-lethal carrier and a non-lethal payload.

The non-lethal carrier includes one or more petals that open at a predetermined time to deploy a non-lethal payload. The opened petals provide a drag force on the non-lethal carrier. The non-lethal payload is restrained within the carrier until deployment at the predetermined time and includes a high drag member to provide a drag force on the payload. The predetermined deployment time is determined based on the distance to a target and also the reaction time of the payload's high drag member to decelerate the non-lethal payload to a non-lethal velocity prior to striking the target.

A second aspect of the invention is a 25 mm non-lethal projectile system for operation within a range of approximately 5 meters to approximately 400 meters. The 25 mm non-lethal projectile comprises a non-lethal carrier, a non-lethal payload and a deployment fuze. The non-lethal carrier includes a plurality of petals enclosing an internal cavity. The petals are opened from an initial non-deployed state to a deployed state at a predetermined time to provide a drag force on the non-lethal carrier and deploy a non-lethal payload. The non-lethal payload is restrained within the internal cavity of the non-lethal carrier until the plurality of petals transition from the non-deployed state to the deployed state. The non-lethal payload further includes a drogue chute to provide a drag force on the non-lethal payload. The deployment fuze charge is housed within the non-lethal carrier and opens the petals from an initial non-deployed state to a deployed state at a predetermined time. The predetermined time is determined according to a distance to a target and the reaction time of the drogue chute on the non-lethal payload to decelerate the non-lethal payload to a non-lethal velocity prior to striking the target.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A non-lethal projectile ammunition comprises a non-lethal carrier with a configurable and deployable payload to allow for effective performance at both long and short ranges. The non-lethal projectile ammunition is fired from a launcher, such as a firearm or weapon system. At a predetermined range, the non-lethal carrier opens thereby deploying the payload. The payload may further comprise a drogue chute to reduce the kinetic energy of the payload to a non-lethal level. Alternatively, the drag coefficient of the payload may enable sufficient reduction of kinetic energy without the need for a drogue chute. The deployed petals of the non-lethal carrier serve as drag surfaces for the carrier, thereby reducing the kinetic energy of the carrier to a non-lethal level.

Advantageously, by selectively deploying and increasing the drag on both the non-lethal carrier and the payload, the payload is accurate and non-lethal at both long and short ranges. In one embodiment, the non-lethal projectile ammunition has an effective range of approximately 5 meters to over 400 meters. Additionally, the non-lethal projectile ammunition allows for launching out of a rifled barrel at a higher muzzle velocity than what is typically used for non-lethal projectiles thereby increasing the accuracy of the round. The higher muzzle velocity also allows for semi-automatic firing of the non-lethal projectile ammunition.

By employing the carrier, payloads of various sizes and weights may be employed, including payloads that alone would not have sufficient aerodynamic qualities to allow for effective and accurate long range use. For example, payloads may include soft rubber bullets, shot-filled bean bags, pepper sprays, tranquilizers, electrical shock, flash bang and concussive type projectiles. The selectable deployment time of the payload ensures that, given the aerodynamic properties of the payload, and any attached drag elements, if required, the payload is decelerated to a non-lethal level.

Figure 1:
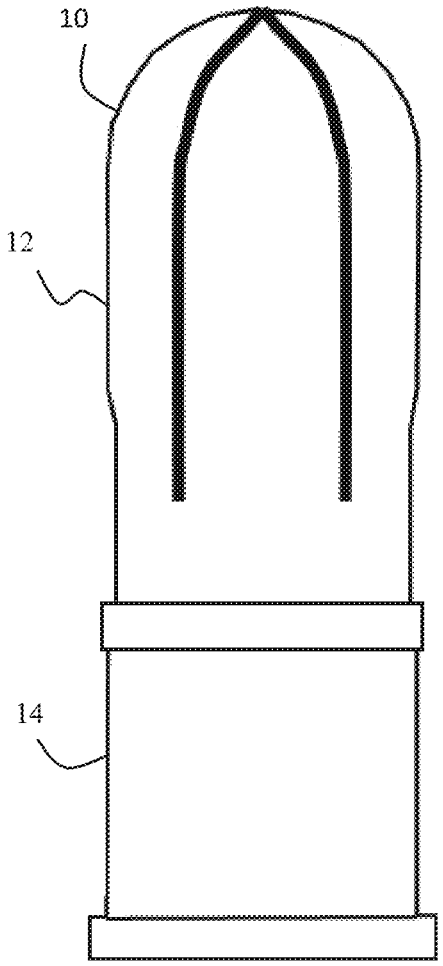
FIG. 1 is a side view of a non-lethal projectile ammunition containing a non-lethal projectile in a non-deployed state, in accordance with one illustrative embodiment.
Figure 2:
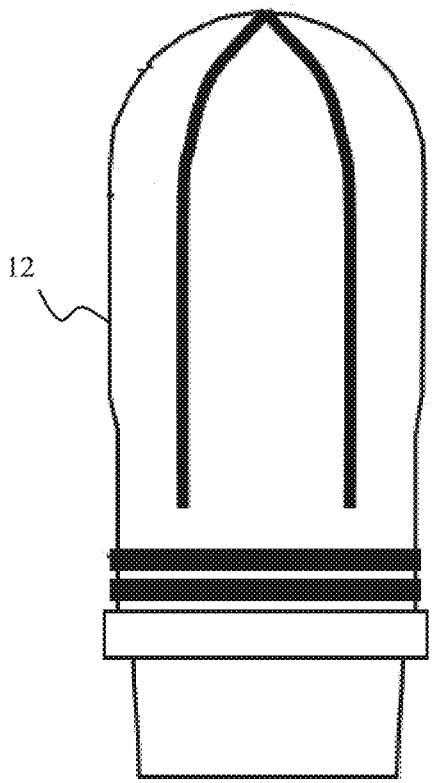
FIG. 2 is a side view of a non-lethal carrier in a non-deployed state, in accordance with one illustrative embodiment.

FIG. 1 is a side view of a non-lethal projectile ammunition containing a non-lethal projectile in a non-deployed state, in accordance with one illustrative embodiment. FIG. 2 is a side view of a non-lethal carrier in a non-deployed state, in accordance with one illustrative embodiment. The non-lethal projectile ammunition 10 comprises a non-lethal carrier 12 disposed in a cartridge case 14. The non-lethal projectile ammunition 10 is configured to be operated in conjunction with a weapon system to discharge the non-lethal carrier 12 from a barrel of the weapon system at a muzzle velocity sufficiently high to produce a flat trajectory and to spin-stabilize the non-lethal carrier when fired from a rifled barrel. While the non-lethal projectile ammunition 10 shown in FIG. 1 is a 25 millimeter round, the non-lethal projectile ammunition 10 is not limited to 25 mm rounds. The non-lethal projectile ammunition 10 may be configured to be operated within any firearm capable of firing a primed cartridge case.

Figure 3:
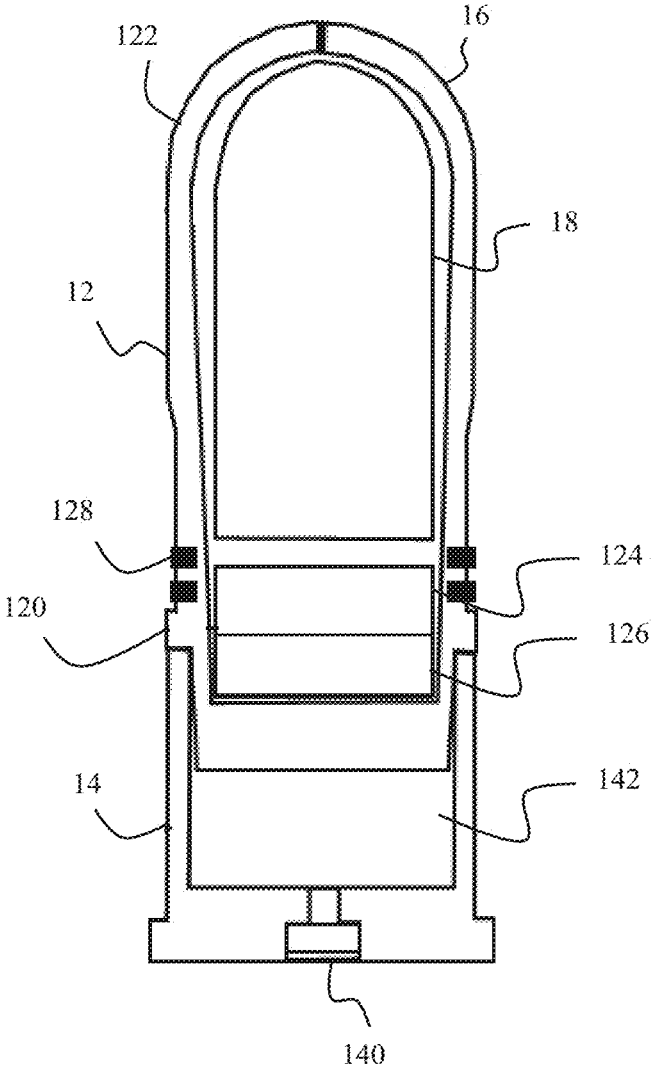
FIG. 3 is a cross sectional view of a non-lethal projectile ammunition showing a non-lethal projectile in a non-deployed state, in accordance with one illustrative embodiment.

FIG. 3 is a cross-section view of a non-lethal projectile ammunition with a non-lethal projectile in a non-deployed state, in accordance with one illustrative embodiment. As used herein, the non-lethal projectile 16 comprises the non-lethal carrier 12 and the payload 18. The primed cartridge case 14 further comprises a primer 140 and an energetic charge 142. The energetic charge 142 is disposed in an interior cavity of the cartridge case 14. A base portion of the non-lethal carrier 12 is inserted into an opening in the top of the cartridge case 14 and disposed in the interior cavity of the cartridge case 14. Subsequent to firing of the weapon system, the primer 140 ignites the energetic charge 142 which expels the non-lethal projectile 16 from the cartridge case 14 and out of the barrel of the weapon system.

In a non-deployed state, the non-lethal carrier-portion 12 of the non-lethal projectile 16 is a hollow cylindrical shell having an aerodynamic nose portion. The base portion of the non-lethal carrier 12 is inserted into the opening in the cartridge case 14. An obturator 120 extending around the circumference of the outer surface of the non-lethal carrier 12 communicates with a top surface of the cartridge case 14. The obturator 120 provides the necessary pressure seal with the barrel to enable expulsion of the non-lethal carrier 12 and engages into the rifling of the launcher barrel to impart spin on the non-lethal carrier 12 such that after leaving the muzzle of the launcher, the non-lethal carrier 12 will have sufficient spin rate to be gyroscopically stable for accuracy out to 400 meters. The non-lethal carrier 12 comprises a plurality of petals 122 extending from the cylindrical base thereby forming the side walls and front nose portion of the non-lethal carrier 12. In the non-deployed state, the petals 122 are connected and constitute an aerodynamically suitable surface for the non-lethal carrier 12.

A payload 18 is disposed in an interior cavity enclosed by the outer shell. The payload is restrained within the interior cavity by the petals 122 when in a non-deployed state.

The interior cavity additionally houses a deployment charge 124 and associated deployment fuze 126. The deployment charge 124 is ignited by the deployment fuze 126 to cause the non-lethal projectile 16 to transition from a non-deployed to deployed state. Upon ignition, the deployment charge 124 pressurizes the interior cavity of the non-lethal carrier 12 causing the petals 122 of the non-lethal carrier 12 to separate and peel back. The deployment charge 124 is selected to provide sufficient force to force the petals 122 open without propelling the payload 18 forward. Once deployed, the petals 122 serve as a drag surface of the non-lethal carrier 12 thereby quickly decelerating the non-lethal carrier 12. The payload 18, unrestrained by the non-lethal carrier 12, travels on its own trajectory due to its inertia and aerodynamic characteristics.

External electrical contacts 128 are disposed on the exterior of the non-lethal carrier 12 for communicating with the deployment fuze 126. Alternatively, the non-lethal carrier 12 may comprise an internal electrical inductive coil, instead of the external contacts 128, for facilitating communication with the fuze setting electronics of the launching weapon. Information communicated to and from the deployment fuze via the external contacts 128, or inductive coil, is used to set the deployment time of the non-lethal carrier 12.

Fuze setting capabilities allows for the launcher to set the fuze 126 of the non-lethal carrier 12 to explode at a predetermined time, or range, after launch to ensure that both the non-lethal carrier 12 and payload 18 are travelling at non-lethal velocities when they reach the target. The predetermined time or range may be based on range to target, payload type, payload weight, muzzle velocity of the launcher, presence or absence of a drogue chute, wind speed and direction and other environmental factors or sensor inputs. For example, certain payloads may require more time from deployment to decelerate to a non-lethal level. The launcher may read the payload type from the projectile ammunition 10 via the external contacts 128 or the inductive coil. By taking into account the payload type and range to target, the launcher can determine the necessary fuze setting to ensure that the payload 18 is deployed at the right distance from the target. The launcher may communicate the predetermined time to the non-lethal carrier's fuze or, alternatively, the ammunition may communicate its particular type, and required deployment time, for deployment prior to striking the target, to the weapon system through the same contacts.

The weight of the payload 18 is approximately 40 grams or less. As discussed further below, given a muzzle velocity of less than or equal to 150 m/sec and deployment of at least 5 meters before the intended target, the payload 18 will fall below the non-lethal kinetic energy level, for this example, of 225 J.

Figure 4:
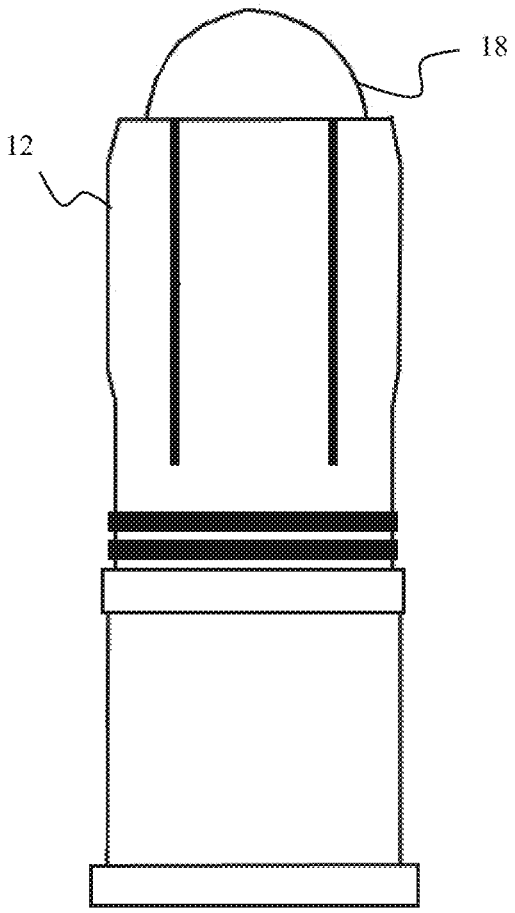
FIG. 4 is a side view of a non-lethal projectile ammunition with an open nose non-lethal projectile in a non-deployed state, in accordance with one illustrative embodiment.
Figure 5:
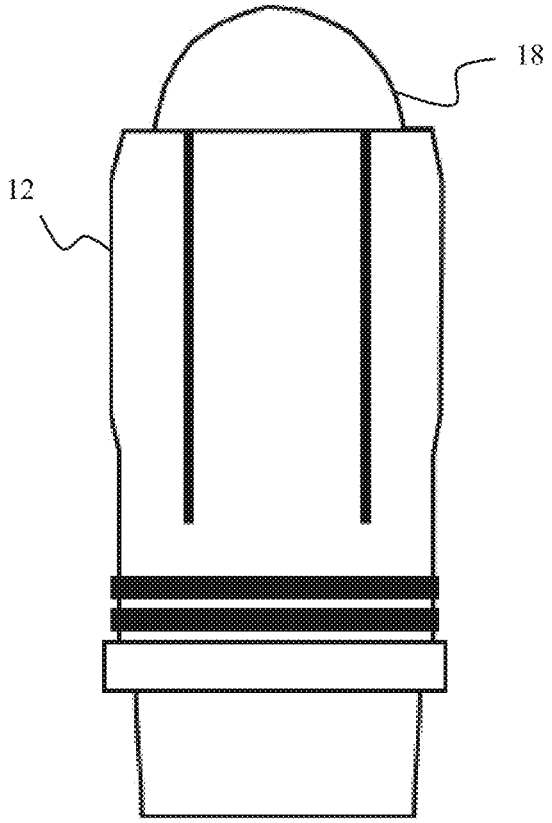
FIG. 5 is a side view of a non-lethal carrier with an open nose in a non-deployed state, in accordance with one illustrative embodiment.

FIG. 4 is a side view of a non-lethal projectile ammunition with an open nose in a non-deployed state, in accordance with one illustrative embodiment. FIG. 5 is a cross section view of a non-lethal carrier 12 of a non-lethal projectile ammunition with an open nose in a non-deployed state, in accordance with one illustrative embodiment. The non-lethal carrier 12 shown in FIG. 4 and FIG. 5, has an open nose, in contrast to the closed nose non-lethal carrier 12 shown in FIGS. 1-3. The closed nose non-lethal carrier 12 is better suited to shot-filled bean bags which do not have a solid consistency and are therefore not self-supporting, while the open nose design would be better for self-supporting payloads 18 such as rubber bullets.

Figure 6:
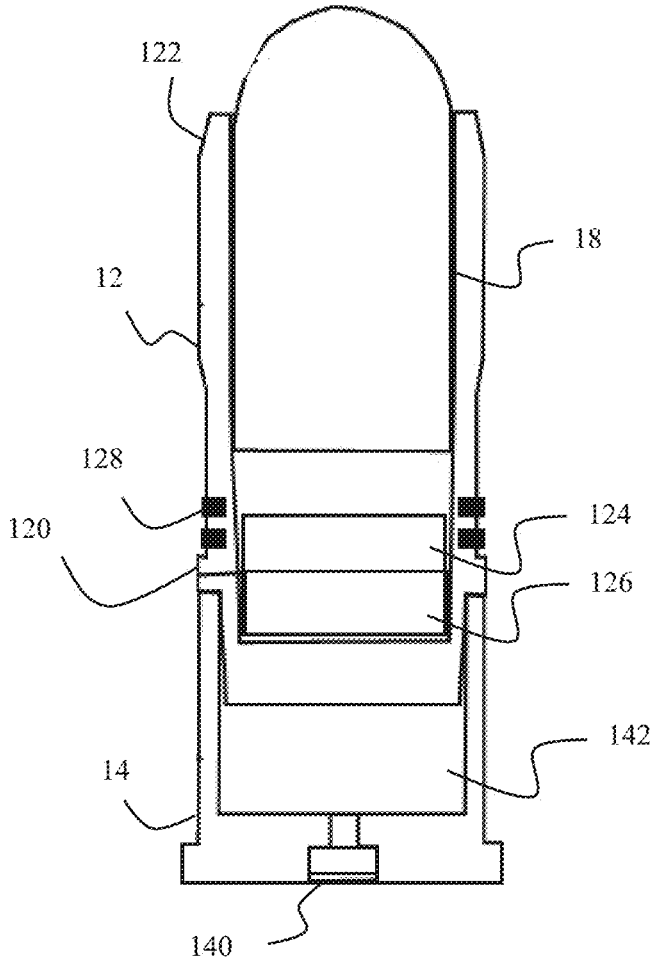
FIG. 6 is a cross sectional view of a non-lethal projectile ammunition showing a non-lethal projectile with an open nose in a non-deployed state, in accordance with one illustrative embodiment.

FIG. 6 is a side view of a non-lethal projectile ammunition with an open nose in a non-deployed state, in accordance with one illustrative embodiment. As shown in FIG. 6, the petals 122 of the non-lethal carrier 12 extend axially along the side walls of the non-lethal carrier 12. The payload 18 protrudes through the opening in the non-lethal carrier 12 and forms the nose of the projectile system.

Advantageously, the non-lethal carrier 12 allows both traditional aerodynamically shaped payloads 18 and non-traditional shaped payloads 18 to be fired at long ranges. While the payloads 18 shown are shot-filled bean bags and rubber bullets, the payloads 18 are not limited to these payload types.

Figure 7:
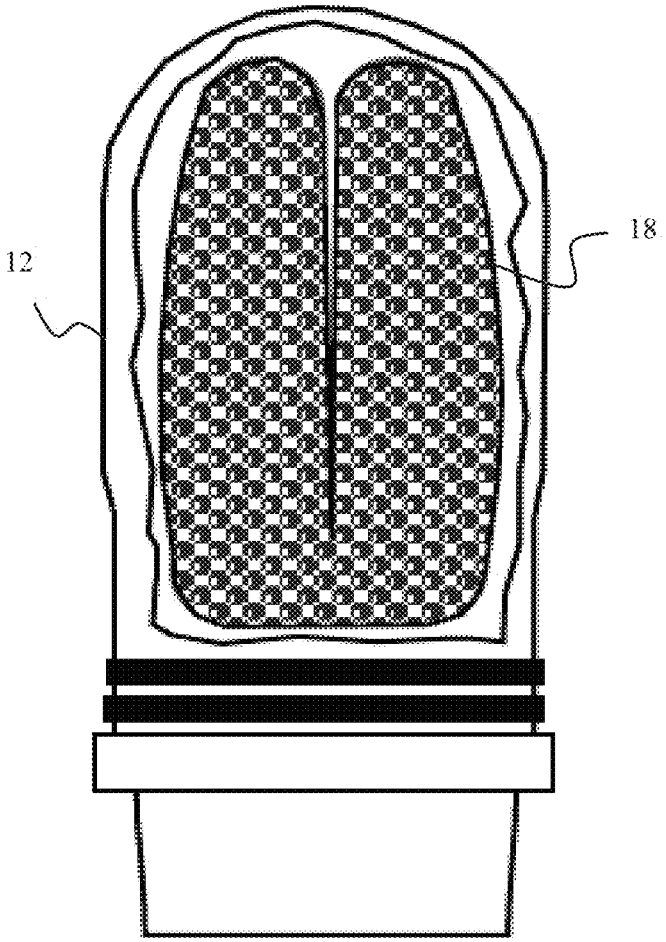
FIG. 7 is a side view of a non-lethal projectile in a non-deployed state with a cutaway section showing a non-lethal flat-circular bean bag payload, in accordance with one illustrative embodiment.

FIG. 7 is a side view of a non-lethal carrier of a non-lethal projectile ammunition in a non-deployed state with a cutaway section showing a non-lethal bean bag payload 18, in accordance with one illustrative embodiment. The bean bag projectile is folded in half within the interior cavity of the non-lethal carrier 12.

Figure 8:
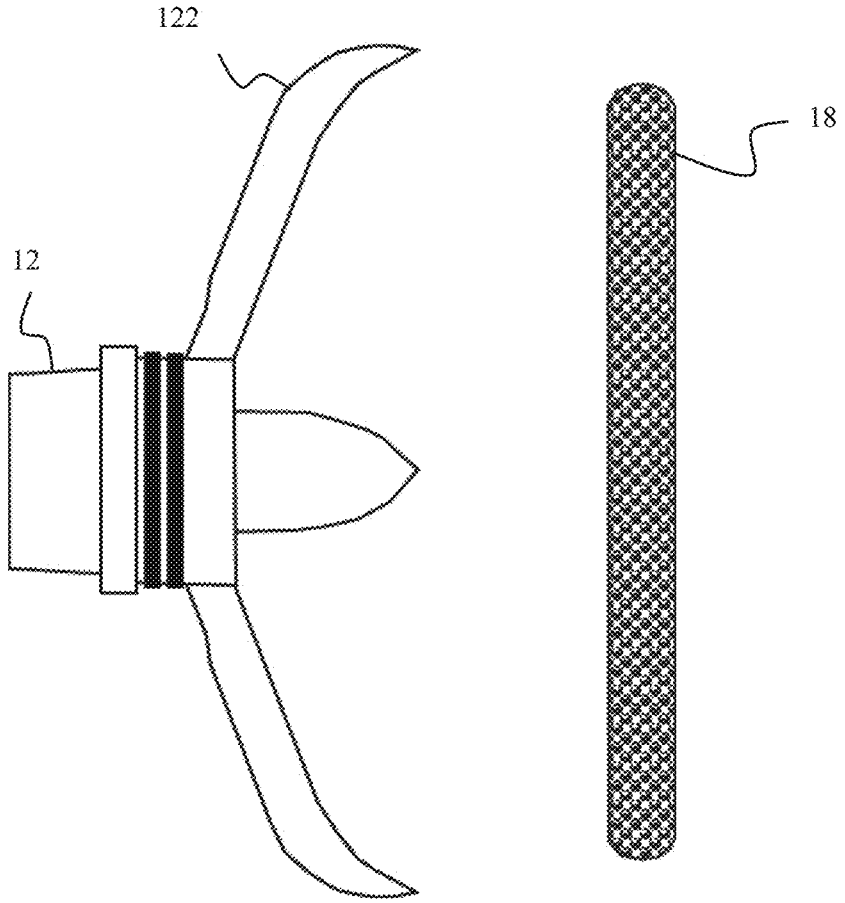
FIG. 8 is a side view of a carrier of a non-lethal projectile in a deployed state and a deployed non-lethal flat-circular bean bag payload, in accordance with one illustrative embodiment.

FIG. 8 is a side view of a non-lethal carrier of a non-lethal projectile ammunition in a deployed state and a deployed payload, in accordance with one illustrative embodiment. At the predetermined time, the deployment charge 124 activates thereby pressurizing the interior cavity and causing the petals 122 of the non-lethal carrier 12 to peel back. Due to the low weight of the non-lethal carrier 12 and the high aerodynamic drag produced by the petals 122, the non-lethal carrier 12 drops away from the payload 18. Upon activation of the deployment charge 124, and assisted by the centrifugal force produced by the high spin rate of the non-lethal carrier 12, the deployed and spinning bean bag flattens out into a high aerodynamic drag circle. In one embodiment, the circle is approximately 75 mm in diameter.

In an alternative embodiment, in which the bean bag does not have sufficient aerodynamic qualities to decelerate it to a safe velocity, the bean bag has an attached drogue chute to impart additional aerodynamic drag on the payload 18. Upon activation of the deployment charge 124, the drogue parachute deploys and decelerates the project. The drogue chute is attached to the payload 18 via a swivel to take into account the high rate of spin imparted to the projectile upon firing. In one embodiment, the drogue chute is approximately 75 mm in diameter.

Figure 9:
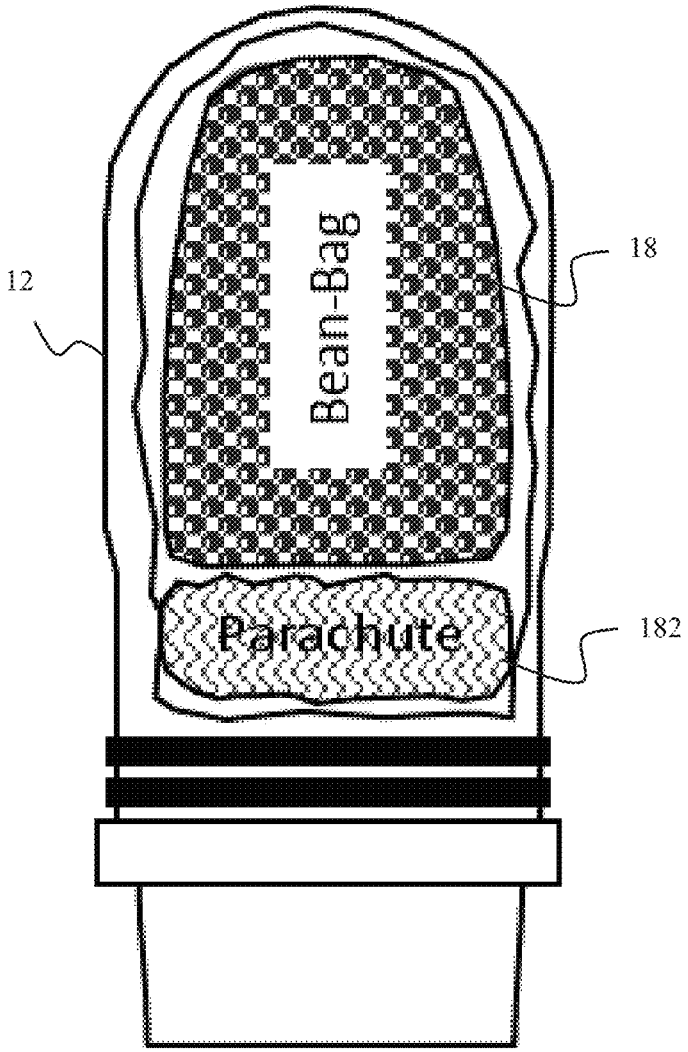
FIG. 9 is a side view of a non-lethal projectile in a non-deployed state with a cutaway section showing a non-lethal bean bag payload with a drogue chute, in accordance with one illustrative embodiment.
Figure 10:
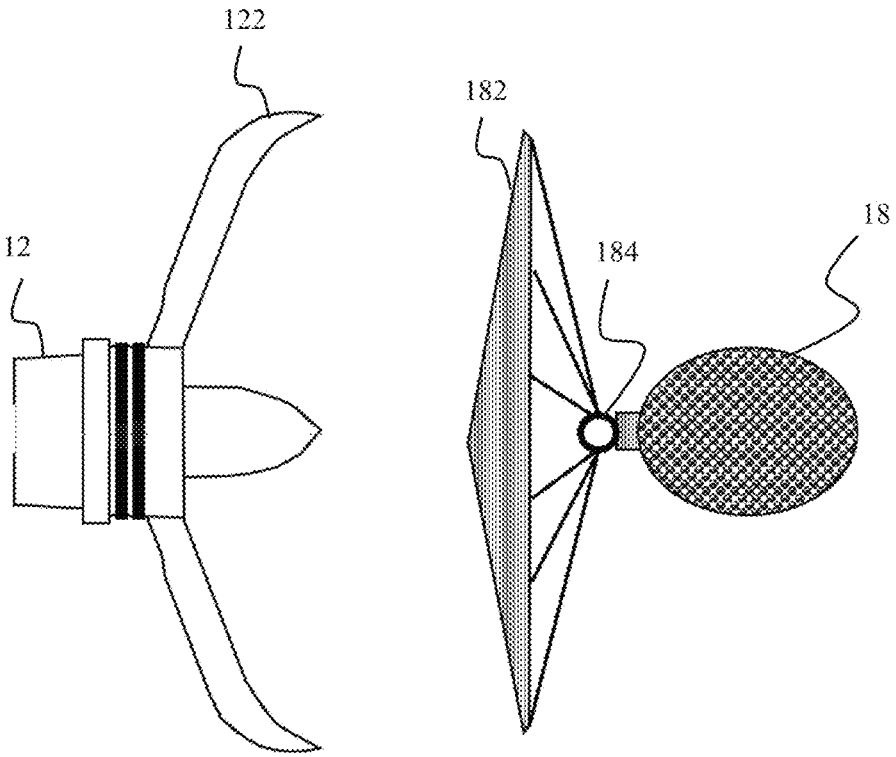
FIG. 10 is a side view of a carrier of a non-lethal projectile in a deployed state and a deployed non-lethal bean bag payload with a drogue chute, in accordance with one illustrative embodiment.

FIG. 9 is a side view of a non-lethal carrier of a non-lethal projectile ammunition in a non-deployed state with a cutaway section showing a non-lethal bean bag payload with a parachute or drogue chute 182 and FIG. 10 is a side view of a non-lethal carrier of a non-lethal projectile ammunition in a deployed state and a deployed bean bag payload with a drogue chute and swivel 184, in accordance with one illustrative embodiment.

Figure 11:
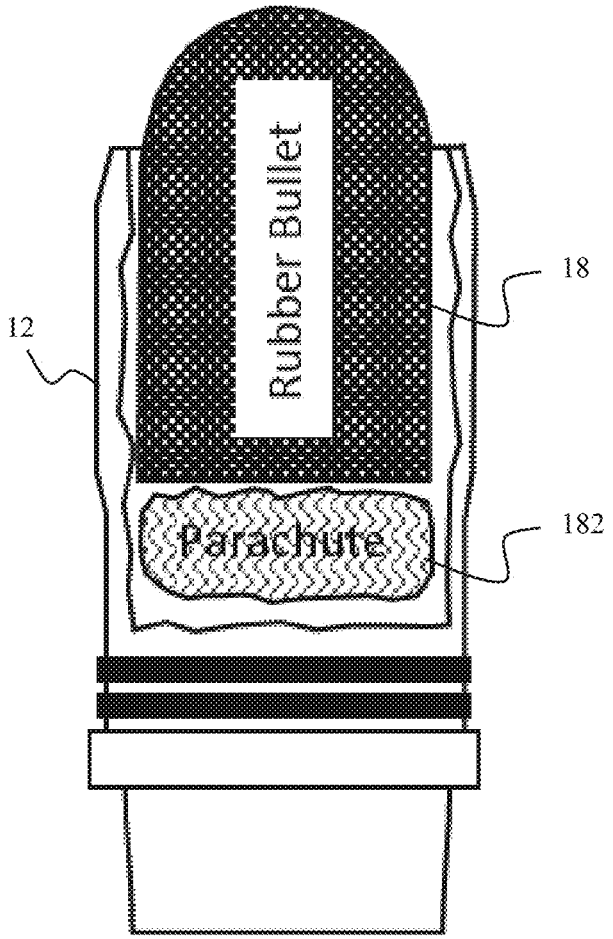
FIG. 11 is a side view of an open-nosed non-lethal projectile in a non-deployed state with a cutaway section showing a non-lethal rubber bullet payload with a drogue chute, in accordance with one illustrative embodiment.
Figure 12:
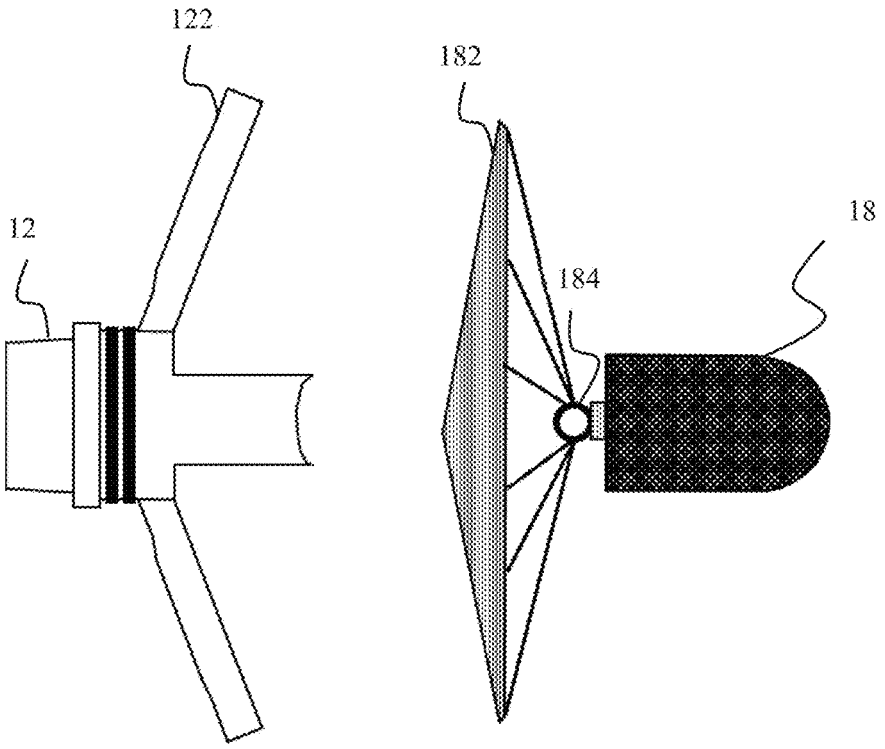
FIG. 12 is a side view of a carrier of a non-lethal projectile in a deployed state and a deployed non-lethal rubber bullet payload with a drogue chute, in accordance with one illustrative embodiment.

FIG. 11 is a side view of a non-lethal carrier of a non-lethal projectile ammunition in a non-deployed state with a cutaway section showing a non-lethal rubber bullet payload with a drogue chute and FIG. 12 is a side view of a non-lethal carrier of a non-lethal projectile ammunition in a deployed state and a deployed rubber bullet payload with a drogue chute and swivel, in accordance with one illustrative embodiment.

The deceleration profile of a representative 40 g projectile having an initial velocity of 150 m/sec and a drag coefficient of 1.28 was modeled. A drag coefficient of 1.28 is the approximate drag coefficient of a 75 mm flat circular disk which corresponds to the embodiments comprising a flat-circular bean bag or a drogue chute of this size. This is a conservative estimate as high drag payloads utilizing a drogue parachute would have a drag coefficient higher than 1.28.

Figure 13:
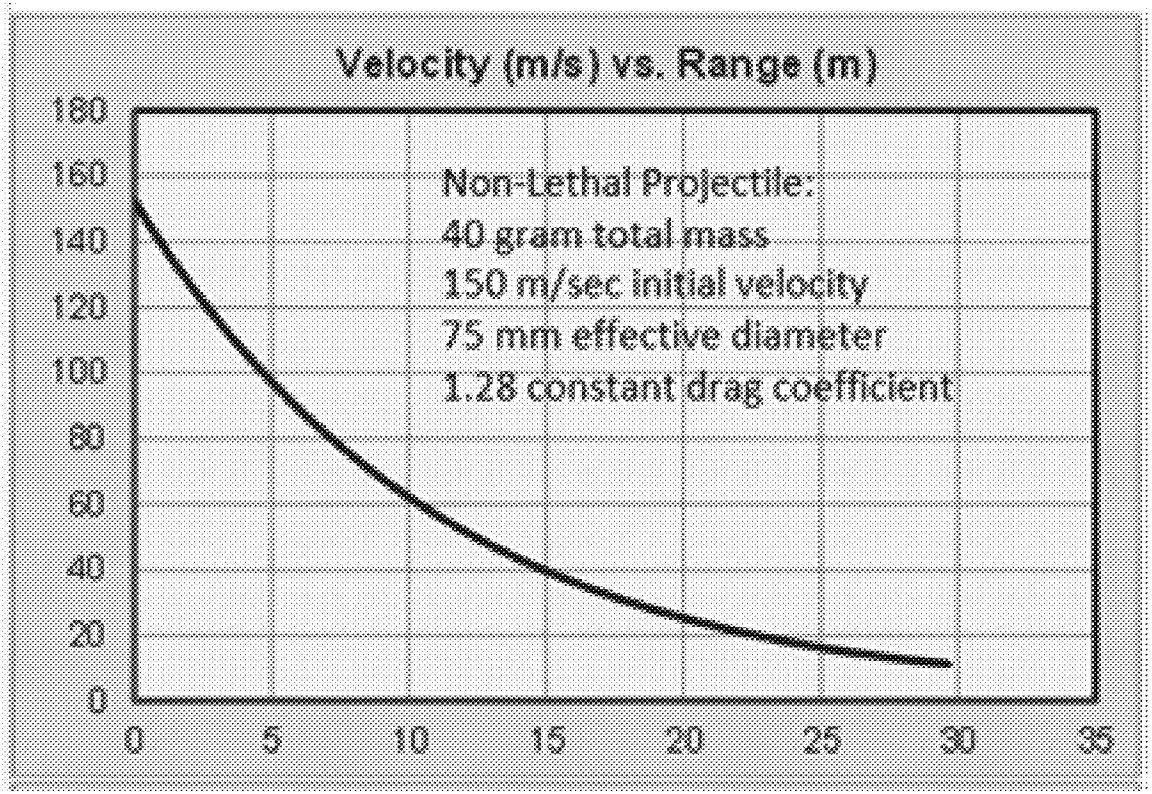
FIG. 13 is a plot showing simulated projectile velocity verses range, from the time of deployment, in accordance with one illustrative embodiment.
Figure 14:
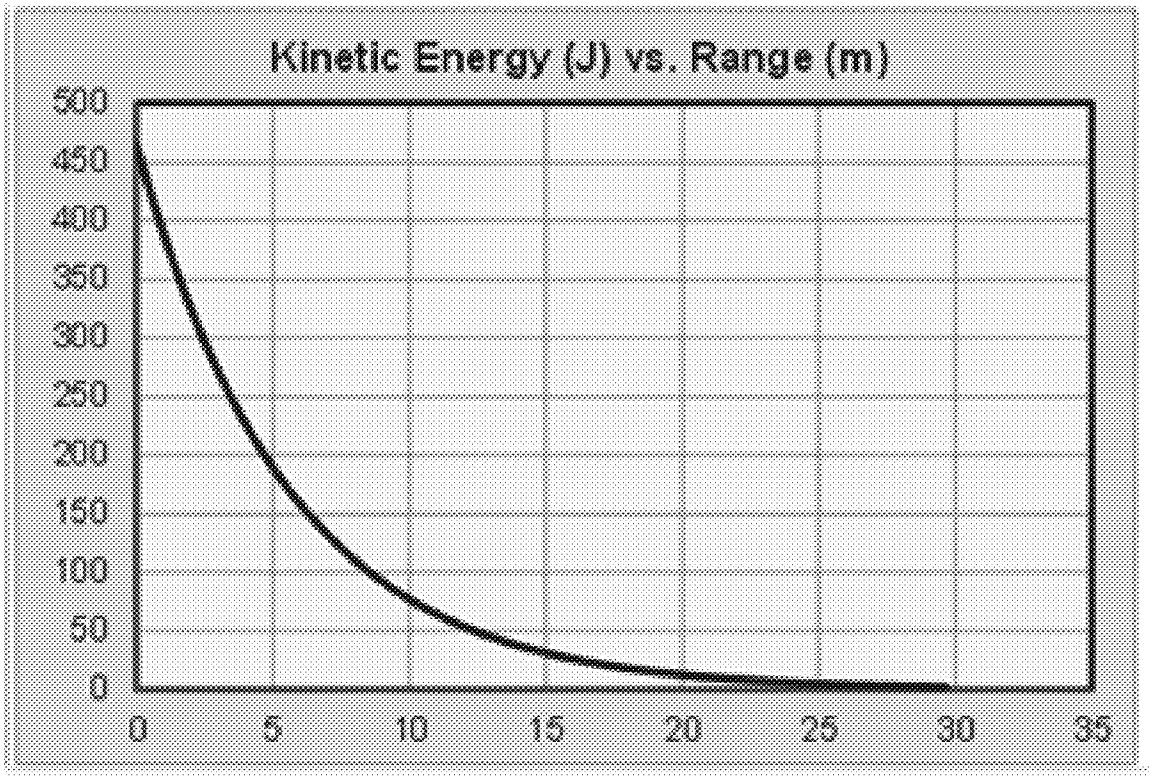
FIG. 14 is a plot showing simulated kinetic energy verses range, from the time of deployment, in accordance with one illustrative embodiment.

FIG. 13 is a plot showing simulated projectile velocity verses range after deployment and FIG. 14 is a plot showing simulated kinetic energy verses range after deployment, in accordance with one illustrative embodiment. As seen in the plot, the projectile decelerates to less than 100 m/s after just 5 meters from deployment of the payload 18. The corresponding kinetic energy of less than 190 J suggests that relatively small drogue chute sizes can reduce projectile velocities to non-lethal levels very quickly, and over very short distances, after deployment.

Figure 15:
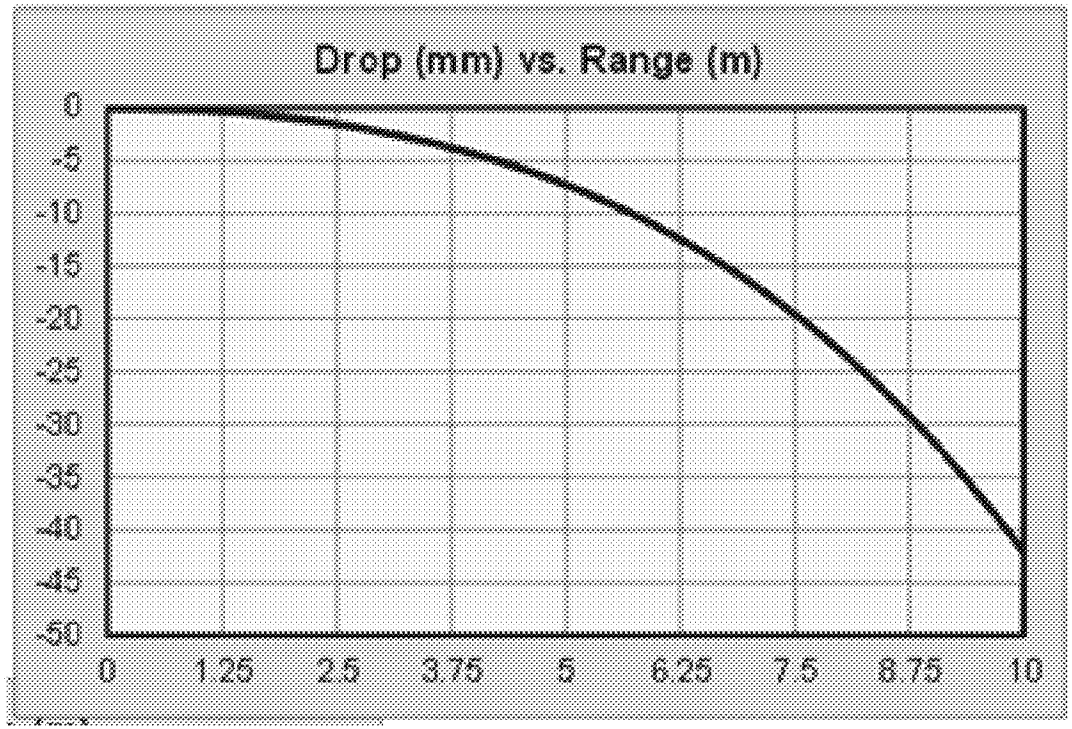
FIG. 15 is a plot showing simulated projectile drop verses range, from the time of deployment, in accordance with one illustrative embodiment.

FIG. 15 is a plot showing simulated projectile drop verses range, in accordance with one illustrative embodiment. As shown in FIG. 15, the drop of the representative payload 18 would be less than 10 mm over the distance of 5 meters.

Advantageously, the additional drop of the projectile due to the deceleration would not need to be compensated for when sighting in on a target.

While the invention has been described with reference to certain embodiments, numerous changes, alterations and modifications to the described embodiments are possible without departing from the spirit and scope of the invention as defined in the appended claims, and equivalents thereof.

What is claimed is:

1. A non-lethal projectile comprising:

a non-lethal carrier partially housed within a primed cartridge case and further comprising an obturator band extending around a circumference of an outer surface of the non-lethal carrier and one or more petals that are selectably opened to deploy a non-lethal payload, wherein the one or more petals when opened provide a first drag force on the non-lethal carrier;

the non-lethal payload, restrained within the non-lethal carrier until deployed, wherein the non-lethal payload comprises a high-drag member to provide a second drag force on the non-lethal payload;

the primed cartridge case projecting the non-lethal carrier and the non-lethal payload with gyroscopic stabilization and on a flat trajectory;

a deployment fuze housed within the non-lethal carrier;

a deployment charge housed within the non-lethal carrier and wherein the deployment charge is detonated by the deployment fuze at a selectable predetermined time and a detonation of the deployment charge creates a pressure within the non-lethal carrier of sufficient force to open the one or more petals thereby deploying the non-lethal payload; and wherein the selectable predetermined time is determined from a distance to a target and and at least one of the following: a shape of the non-lethal payload and an expected material deformation of the non-lethal payload upon an impact.

2. The non-lethal projectile of claim 1 wherein the distance to the target from which the selectable predetermined time is determined is within a range of 5 meters to 400 meters.

3. The non-lethal projectile of claim 1 wherein the non-lethal payload comprises a disk shape and an angular momentum of the gyroscopically stabilized non-lethal payload aids in expanding the non-lethal payload.

4. The non-lethal projectile of claim 1 wherein the one or more petals of the non-lethal carrier, in a closed state, fully enclose the payload.

5. The non-lethal projectile of claim 1 wherein the one or more petals of the non-lethal carrier, in a closed state, enclose a portion of the payload with a remaining portion of the payload protruding beyond the one or more petals.

6. The non-lethal projectile of claim 1 wherein the high-drag member of the non-lethal payload is a drogue parachute.

7. The non-lethal projectile of claim 1 wherein the non-lethal carrier further comprises external contacts providing electrical communication with the deployment fuze.

8. The non-lethal projectile of claim 7 wherein the non-lethal carrier communicates payload information comprising a payload type.

9. A 25 mm non-lethal projectile for operation within a range of 5 meters to 400 meters comprising:

a non-lethal carrier partially housed within a primed cartridge case and further comprising an obturator band extending around a circumference of an outer surface of the non-lethal carrier and a plurality of petals enclosing an internal cavity and which are opened from an initial non-deployed state to a deployed state to provide a first drag force on the non-lethal carrier and deploy a non-lethal payload;

the non-lethal payload restrained within the internal cavity of the non-lethal carrier until the plurality of petals transition from the initial non-deployed state to the deployed state and further comprising a drogue chute to provide a second drag force on the non-lethal payload;

the primed cartridge case projecting the non-lethal carrier and the non-lethal payload with gyroscopic stabilization on a flat trajectory;

a deployment charge housed within the non-lethal carrier for opening the plurality of petals from the initial non-deployed state to the deployed state at a selectable predetermined time, wherein the selectable predetermined time is determined according to a distance to a target within the range of 5 meters to 400 meters and a reaction time of the drogue chute to decelerate the non-lethal payload to a non-lethal velocity prior to striking the target;

a deployment fuze housed within the non-lethal carrier for initiating the deployment charge; and external contacts located on an outer surface of the non-lethal carrier and in electrical communication with the deployment fuze.

* * * * *